US010590520B2

(12) United States Patent
Smarsly et al.

(10) Patent No.: US 10,590,520 B2
(45) Date of Patent: Mar. 17, 2020

(54) HIGH TEMPERATURE RESISTANT TIAL ALLOY, PRODUCTION METHOD THEREFOR AND COMPONENT MADE THEREFROM

(71) Applicant: MTU Aero Engines AG, Munich (DE)

(72) Inventors: Wilfried Smarsly, Munich (DE); Martin Schloffer, Munich (DE); Helmut Clemens, Leoben (AT); Thomas Klein, Leoben (AT)

(73) Assignee: MTU AERO ENGINES AG, Munich (DE)

( * ) Notice: Subject to any disclaimer, the term of this patent is extended or adjusted under 35 U.S.C. 154(b) by 235 days.

(21) Appl. No.: 15/644,927

(22) Filed: Jul. 10, 2017

(65) Prior Publication Data

US 2018/0016668 A1 Jan. 18, 2018

(30) Foreign Application Priority Data

Jul. 12, 2016 (EP) ..... 16178936

(51) Int. Cl.
*C22F 1/18* (2006.01)
*C22C 30/00* (2006.01)
*C22C 14/00* (2006.01)

(52) U.S. Cl.
CPC ..... *C22F 1/183* (2013.01); *C22C 14/00* (2013.01); *C22C 30/00* (2013.01)

(58) Field of Classification Search
CPC ..... C22C 14/00; C22C 30/00; C22F 1/183; C22F 1/04
See application file for complete search history.

(56) References Cited

U.S. PATENT DOCUMENTS

| | | | | |
|---|---|---|---|---|
| 4,229,216 | A | 10/1980 | Paton et al. | |
| 8,888,461 | B2 | 11/2014 | Smarsly et al. | |
| 9,994,934 | B2 * | 6/2018 | Smarsly | C22C 1/02 |
| 2011/0189026 | A1 | 8/2011 | Smarsly et al. | |
| 2012/0041276 | A1 | 2/2012 | Doreus et al. | |

(Continued)

FOREIGN PATENT DOCUMENTS

| | | | |
|---|---|---|---|
| DE | 102006052650 | A1 | 7/2007 |
| EP | 2851445 | A1 | 3/2015 |

(Continued)

OTHER PUBLICATIONS

Larson, D. J., and M. K. Miller. "Precipitation and segregation in α2+ γ titanium aluminides." Materials Science and Engineering: A 250.1 (1998): 65-71.*

(Continued)

*Primary Examiner* — Jessee R Roe
(74) *Attorney, Agent, or Firm* — Abel Schillinger, LLP

(57) ABSTRACT

Described is a TiAl alloy which, besides titanium, comprises 42 to 48 at. % aluminum, 3 to 5 at. % niobium, 0.05 to 1 at. % molybdenum, 0.2 to 2.2 at. % silicon, 0.2 to 0.4 at. % carbon, 0.05 to 0.2 at. % boron, and optionally tungsten, zirconium and hafnium, as well as unavoidable impurities, and at room temperature has a microstructure which comprises globular colonies of lamellae of $\alpha_2$-$Ti_3Al$ and γ-TiAl, as well as silicide precipitates, and essentially no β phase. A method for producing a component made of this alloy is also described.

20 Claims, 1 Drawing Sheet

(56) References Cited

U.S. PATENT DOCUMENTS

| | | | | |
|---|---|---|---|---|
| 2012/0107132 | A1 | 5/2012 | Thomas et al. | |
| 2015/0086414 | A1* | 3/2015 | Smarsly | C22C 1/02 420/418 |
| 2016/0010184 | A1 | 1/2016 | Smarsly et al. | |

FOREIGN PATENT DOCUMENTS

| | | | |
|---|---|---|---|
| WO | 2009052792 | A2 | 4/2009 |
| WO | 2010086372 | A1 | 8/2010 |
| WO | 2012041276 | A2 | 4/2012 |

OTHER PUBLICATIONS

Klein Thomas et al: "Silicon distribution and silicide precipitation during annealing in an advanced multi-phase [gamma]-TiAl based alloy" Acta Materialia, Elsevier, Oxford, GB, vol. 110, Mar. 23, 2016, pp. 236-245.

* cited by examiner

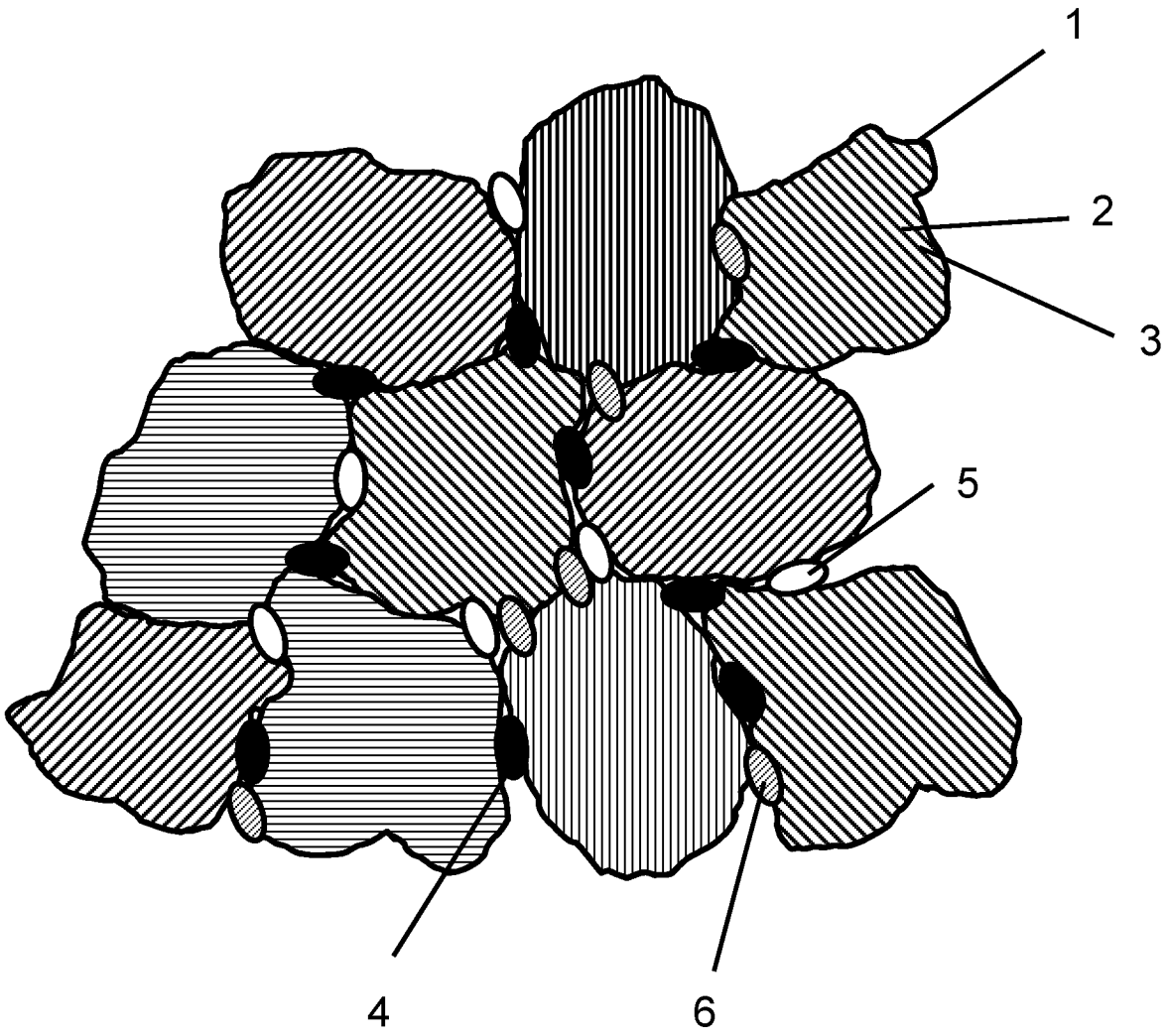
1
2
3
4
5
6

HIGH TEMPERATURE RESISTANT TIAL ALLOY, PRODUCTION METHOD THEREFOR AND COMPONENT MADE THEREFROM

CROSS-REFERENCE TO RELATED APPLICATIONS

The present application claims priority under 35 U.S.C. § 119 of European Patent Application No. 16178936.7, filed Jul. 12, 2016, the entire disclosure of which is expressly incorporated by reference herein.

BACKGROUND OF THE INVENTION

1. Field of the Invention

The present invention relates to a high-temperature-resistant TiAl alloy, to a method for producing a component made of such α-TiAl alloy, and to a corresponding component.

2. Discussion of Background Information

TiAl alloys, which have titanium and aluminum as main constituents—i.e. as chemical elements having the highest proportions in the composition—are used as materials for moving parts in motors and gas turbines, for example as rotor blades, because of their low specific weight and their good strength properties, in particular high-temperature strength properties. One example of a TiAl alloy and its use in turbomachines, such as aircraft engines, is given in WO 2009/052792 A2, the entire disclosure of which is incorporated by reference herein, which describes a TiAl material for a gas turbine breakdown part, which comprises 42 to 45 at. % aluminum, 3 to 8 at. % niobium, 0.2 to 0.3 at. % molybdenum and/or manganese, 0.1 to 1 at. % boron and/or carbon and/or silicon, the remainder being titanium. This alloy is adjusted during production in such a way that the material has β-Ti phase and/or B2-Ti phase at room temperature, both of which will in the following be referred to in short as β phase. The β phase is in this case used so that, at high temperatures at which in TiAl alloys having a correspondingly high proportion of aluminum, a substantial part of the material may be present as an α-Ti phase with high aluminum solubility, to avoid coarsening of the α-Ti grains, in order to achieve a homogeneous configuration that is favorable for ductility and creep strength of the material, with uniform configurational structures that are not too coarse. The β phase in this case stabilizes the grain boundaries of the α-Ti grains, and thus counteracts coarsening.

Such TiAl alloys, however, still have deficiencies in terms of creep strength, so that there is a need for improvement particularly in this regard.

It would therefore be advantageous to have available a TiAl alloy, a method for producing a component made of a TiAl alloy, and a corresponding component, the TiAl alloy and the components produced therefrom having a balanced property profile with sufficient strength, ductility, and in particular creep strength.

SUMMARY OF THE INVENTION

This present invention provides a TiAl alloy, a method for producing a component made of a TiAl alloy, and a component made of a TiAl alloy, as specified in the independent claims. The dependent claims relate to advantageous designs.

In order to improve the creep strength of TiAl alloys, or components produced therefrom, in particular for turbomachines such as gas turbines and aircraft engines, the invention proposes to substantially do away with the β phase for hindering the grain growth of α-Ti grains at high temperatures, and to hinder growth of the α-Ti grains at high temperatures by precipitation of silicides. The term "substantially do away with the β phase" or "essentially no β phase" means in this context that the β phase makes up less than 5 vol. %, preferably less than 2 vol. %, and more preferably about 0 vol. %, in the finished alloy. By avoiding the β phase, or restricting the β phase to minimal proportions in the configuration, the creep strength can be improved, while at the same time a homogeneous configuration with fine structures can furthermore be achieved. To this end, the invention proposes to select α-TiAl alloy which, besides the main alloy constituents titanium and aluminum, comprises at least niobium, molybdenum and silicon, the silicon being provided in order to form the silicides that are intended to hinder grain growth of the α-Ti grains at correspondingly high temperatures, in order to counteract coarsening of the microstructure. The TiAl alloy should be selected in such a way that, with the selected chemical composition of the TiAl alloy, there is an α phase temperature range, in the temperature range of which there is essentially an α-Ti phase with silicides. A corresponding TiAl alloy, which is essentially present in the form of α-Ti in a particular temperature interval for the given chemical composition, may be determined by simulation calculations with corresponding simulation programs, which take a multiplicity of thermodynamic data into account, and/or by the production of corresponding test melts or test alloys and metallographic examination of the test alloys.

When a corresponding TiAl alloy has been selected, having a particular chemical composition that has an α phase temperature range within which the corresponding TiAl alloy is essentially present in a single phase as an α-Ti phase, there only additionally being silicides in the temperature range, in the method according to the invention such a TiAl alloy having the selected chemical composition is incited and subsequently, in a further step, cast to form a semifinished product or atomized to foam TiAl powder, in which case the semifinished product may already be an intermediate product of near-net shape or a starting product for further shaping to form a preliminary product. For example, the cast semifinished product may be shaped by forging to form a preliminary product. The TiAl powder may be used for further processing in powder-metallurgical production methods such as generative manufacturing methods, or compressed, assembled and/or shaped, by hot isostatic pressing (HIP) or the like, so as likewise to provide a preliminary product.

The cast semifinished product, or a preliminary product produced from the semifinished product or from the TiAl powder, is subsequently cooled from a silicide starting temperature so that silicides can be precipitated, in order to carry out precipitation stabilization. The cooling from the silicide starting temperature may for example be carried out directly after casting of the semifinished product, during cooling of the cast piece, or if the semifinished product is shaped after casting by hot forming to form a preliminary product, by cooling from the shaping temperature. Furthermore, after its production, the preliminary product may be heated to a silicide starting temperature and the preliminary product may be cooled from the silicide starting temperature in such a way that the desired silicides are precipitated. If the TiAl alloy is used as a powder for the powder-metallurgical production of a component, for example for the additive manufacture of a component by layerwise deposition of the powder particles or by vacuum-tight encapsulation and fusion of the powder by hot isostatic pressing to form a preliminary product, the preliminary product produced using the powder may likewise be brought to a silicide starting temperature and cooled therefrom in such a way that the desired silicides are precipitated. During powder-metallurgical production as well, the preliminary product may be cooled from a temperature already existing during production, for example the HIP temperature, in such a way that silicide precipitation takes place. In this case, the HIP temperature is thus the silicide starting temperature. In order to allow precipitation of the silicides, the cooling from the silicide starting temperature must be carried out sufficiently slowly in order to provide the opportunity for the precipitation of the silicides.

Subsequently, in a further step of the method according to the invention, a heat treatment of the precipitation-stabilized semifinished product or preliminary product is carried out in the α phase temperature range, in which the semifinished product or preliminary product is present essentially as an α-Ti phase with precipitated silicides, the silicides counteracting coarsening of the α-Ti grains. During this step, the β phase present is substantially or fully dissolved. The heat treatment in the α phase temperature range may be carried out for a duration of from 0.5 to 2 hours, in particular from 0.5 to 1 hour, the cooling being carried out in such a way that globular colonies of lamellae of $\alpha_2$-$Ti_3Al$ and γ-TiAl are formed from the α-Ti grains, the silicide precipitates produced during the precipitation stabilization of the material additionally being present. A microstructure is therefore obtained, which has an outstanding, balanced property profile with improved creep strength.

The silicide starting temperature, to which a semifinished product after casting, or a preliminary product shaped after casting, or a preliminary product produced by a powder-metallurgical method, is heated during the precipitation stabilization of the TiAl alloy, may be a temperature above the silicide dissolution temperature of the material, so that the silicon is substantially in solution at the silicide starting temperature, in order then to allow homogeneous precipitation of the silicides during cooling of the semifinished product or preliminary product. If, for example, coarse silicides are present because of the casting process, these may be dissolved above a silicide dissolution temperature by the solution heat treatment at the silicide starting temperature. The microstructure thereby coarsened may be refined by forging, in which case fine silicides may be precipitated by controlled cooling from the forging temperature. The silicide starting temperature may however also lie below a silicide dissolution temperature, when the silicide starting temperature is the temperature during shaping or compaction of a semifinished product or of a preliminary product. For example, when consolidating the powder by HIP, or when recompacting a powder-metallurgically constructed preliminary product by HIP, a temperature significantly below the silicide dissolution temperature may be adjusted, so that the silicides can be formed.

Correspondingly, the α phase temperature range, in which the subsequent heat treatment of the precipitation-stabilized semifinished product or preliminary product is carried out, may lie below a silicide dissolution temperature of the TiAl alloy and above a γ solvus temperature at which the entire γ-TiAl phase enters into solution in the α-Ti phase, so as to ensure that there is essentially only an α-Ti phase in the α phase temperature range, except for the present silicides. In particular, the proportion of the α-Ti phase in the α phase temperature range may lie in a range of about 95 vol. % or more, in particular about 98 vol. % or more.

A corresponding TiAl alloy, which has a suitable α phase temperature range with a sufficiently high silicide dissolution temperature and γ solvus temperature that is at least 15 K, in particular at least 20 K lower, at which there are no longer any proportions of γ-TiAl, but only an α-Ti phase, may according to another aspect of the invention, for which protection is sought separately and in combination with other aspects of the invention, comprise or consist of a chemical composition having 42 to 48 at. % aluminum, preferably 43 to 45 at. % aluminum, 3 to 5 at. % niobium, preferably 3.5 to 4.5 at. % niobium, 0.05 to 1 at. % molybdenum, preferably 0.85 to 0.95 at. % molybdenum, 0.2 to 2.2 at. % silicon, preferably 0.25 to 0.35 at. % silicon, 0.2 to 0.4 at. % carbon, preferably 0.25 to 0.35 at. % carbon, 0.05 to 0.2 at. % boron, preferably 0.05 to 0.15 at. % boron, as well as titanium and unavoidable impurities, titanium being present in a quantity such that the sum of the chemical elements contained amounts to 100 at. %.

Embodiments of the TiAl alloy, which may in particular be produced by the production method described above, or components made of this TiAl alloy, may have exactly the composition described above, or may contain further chemical elements, in particular at least one element from the group which comprises tungsten, zirconium and hafnium, since the described microstructure at room temperature, or in the α phase temperature range, may also be adjusted with such alloys, and the aforementioned alloy constituents may impart additional properties to the alloys, or to the components produced therewith.

The TiAl alloy may, according to one advantageous embodiment, besides titanium and unavoidable impurities, contain 43.5 to 45 at. % aluminum, 3.5 to 4.5 at. % niobium, 0.1 to 0.5 at. % molybdenum, 0.4 to 1 at. % tungsten, 0.25 to 0.35 at. % silicon, 0.25 to 0.35 at. % carbon, and 0.05 to 0.15 at. % boron, in which case the alloy may have exactly this composition or may comprise further additional alloy elements. In each case, the proportion of titanium is selected such that the sum of the chemical elements of the alloy amounts to 100 at. %

The TiAl alloy may, according to a further advantageous embodiment, besides titanium and unavoidable impurities, contain 43.5 to 45 at. % aluminum, 3.5 to 4.5 at. % niobium, 0.85 to 0.95 at. % molybdenum, 0.1 to 3 at. % zirconium, 0.25 to 2.2 at. % silicon, 0.25 to 0.35 at. % carbon, and 0.05 to 0.15 at. % boron, in which case the alloy may have exactly this composition or may comprise further additional alloy elements. In each case, the proportion of titanium is selected such that the sum of the chemical elements of the alloy amounts to 100 at. %.

The TiAl alloy may, according to a further advantageous embodiment, besides titanium and unavoidable impurities, contain 46 to 48 at. % aluminum, 3.5 to 5 at. % niobium, 0.1 to 0.5 at. % molybdenum, 0.4 to 1.8 at. % tungsten, 0.1 to 3 at. % zirconium, 0.35 to 2.2 at. % silicon, 0.25 to 0.35 at. % carbon, and 0.05 to 0.15 at. % boron, in which case the alloy may have exactly this composition or may comprise further additional alloy elements. In each case, the proportion of titanium is selected such that the sum of the chemical elements of the alloy amounts to 100 at. %.

In these alloys, for example, boron and carbon may both contribute to solid solution strengthening of the alloy and also produce borides and/or carbides, which may positively influence the microstructural formation in terms of a homogeneous microstructure with suitable colony sizes and lamella thicknesses or spacings of the $\alpha_2$-$Ti_3Al$ and γ-TiAl lamellae.

In the method for producing a component made of α-TiAl alloy, the semifinished product or preliminary product heat-treated in the α phase temperature range may subsequently be subjected to a second heat treatment at a temperature below a γ solvus temperature of the material, in order to influence the formation of lamellae of $\alpha_2$-$Ti_3Al$ and γ-TiAl from the α-Ti grains and to adjust desired lamella thicknesses or spacings.

A corresponding TiAl alloy, or a component produced therefrom, may therefore have less than 5 vol. % of β phase, and preferably no β phase at all, at working temperatures of up to 1000° C., so that the creep strength is improved.

The globular colonies comprising Lamellae of $\alpha_2$-$Ti_3Al$ and γ-TiAl may form at room temperature 95 vol. % or more, in particular 98 vol. % or more of the TiAl alloy. The rest may be formed by silicides, carbides and/or borides, in which case the TiAl alloy may contain up to 5 wt. %, preferably up to 2 wt. % silicides, carbides and/or borides, the average or maximum grain size of which may be less than or equal to 5 μm.

The globular colonies of $\alpha_2$-$Ti_3Al$ and γ-TiAl lamellae may have an average or maximum size of from 50 to 300 μm, in particular from 100 to 200 μm, in which case the average lamella spacing may lie in the range of from 10 nm to 1 μm. Here, the lamella spacing is intended to mean the spacing of lamellae of the same phase, i.e. the spacing of one γ-TiAl lamella from the next γ-TiAl lamella, or the spacing of one $\alpha_2$-$Ti_3Al$ lamella from the next $\alpha_2$-$Ti_3Al$ lamella.

BRIEF DESCRIPTION OF THE DRAWING

The appended drawing purely schematically shows the configuration of α-TiAl alloy according to the invention, or of a component made of α-TiAl alloy.

DETAILED DESCRIPTION OF EMBODIMENT OF THE INVENTION

Other advantageous characteristics and features of the present invention will become clear in the following detailed description of an exemplary embodiment, the invention not being restricted to this exemplary embodiment.

For a TiAl alloy which consists of 43.8 at. % aluminum, 4 at. % niobium, 0.9 at. % molybdenum, 0.3 at. % silicon, 0.3 at. % carbon, 0.1 at. % boron, the remainder being titanium and unavoidable impurities, by the corresponding heat treatments in the α phase temperature range and a subsequent second heat treatment at a temperature below the γ solves temperature of the TiAl alloy, a microstructure can be formed which is represented in the appended drawing. The globular colonies 1 of $\alpha_2$-$Ti_3Al$ lamellae 2 and γ-TiAl lamellae 3 are formed equiaxially with similar sizes and spherical shapes, silicides 4 as well as borides 5 and carbides 6 having been precipitated at the boundaries of the colonies 1.

LIST OF REFERENCE NUMERALS

1 globular colonies
2 $\alpha_2$-$Ti_3Al$ lamellae
3 γ-TiAl lamellae
4 silicides
5 borides
6 carbides

What is claimed is:

1. A TiAl alloy, wherein the alloy comprises
from 43.5 to 45 at. % aluminum,
from 3.5 to 4.5 at. % niobium,
from 0.1 to 0.5 at. % molybdenum,
from 0.4 to 1 at. % tungsten,
from 0.25 to 0.35 at. % silicon,
from 0.25 to 0.35 at. % carbon,
from 0.05 to 0.15 at. % boron,
and unavoidable impurities, titanium being provided in a quantity such that the sum of proportions of chemical elements amounts to 100 at. %, and the TiAl alloy having at room temperature a microstructure which comprises globular colonies of lamellae of $\alpha_2$-$Ti_3Al$ and γ-TiAl, as well as silicide precipitates, and essentially no β phase.

2. A component made of the TiAl alloy of claim 1.

3. The component of claim 2, wherein the TiAl alloy comprises less than 5 vol. % of β phase at working temperatures of up to 900° C.

4. The component of claim 2, wherein the globular colonies of lamellae of $\alpha_2$-$Ti_3Al$ and γ-TiAl form at least 95 vol. % of the TiAl alloy.

5. The component of claim 2, wherein the TiAl alloy contains up to 5 wt. % of silicides, carbides and/or borides, an average or maximum grain size of the silicides, carbides and/or borides being less than or equal to 5 μm.

6. A TiAl alloy, wherein the alloy comprises
from 43.5 to 45 at. % aluminum,
from 3.5 to 4.5 at. % niobium,
from 0.85 to 0.95 at. % molybdenum,
from 0.1 to 3 at. % zirconium,
from 0.25 to 2.2 at. % silicon,
from 0.25 to 0.35 at. % carbon,
from 0.05 to 0.15 at. % boron,
and unavoidable impurities, titanium being provided in a quantity such that the sum of proportions of chemical elements amounts to 100 at. %, and the TiAl alloy having at room temperature a microstructure which comprises globular colonies of lamellae of $\alpha_2$-$Ti_3Al$ and γ-TiAl, as well as silicide precipitates, and essentially no β phase.

7. A component made of the TiAl alloy of claim 6.

8. The component of claim 7, wherein the TiAl alloy comprises less than 5 vol. % of β phase at working temperatures of up to 900° C.

9. The component of claim 7, wherein the globular colonies of lamellae of $\alpha_2$-$Ti_3Al$ and γ-TiAl form at least 95 vol. % of the TiAl alloy.

10. A TiAl alloy, wherein the alloy comprises
from 46 to 48 at. % aluminum,
from 3.5 to 5 at. % niobium,
from 0.1 to 0.5 at. % molybdenum,
from 0.4 to 1.8 at. % tungsten,
from 0.1 to 3 at. % zirconium,
from 0.35 to 2.2 at. % silicon,
from 0.25 to 0.35 at. % carbon,
from 0.05 to 0.15 at. % boron,
and unavoidable impurities, titanium being provided in a quantity such that the sum of proportions of chemical elements amounts to 100 at. %, and the TiAl alloy having at room temperature a microstructure which comprises globular colonies of lamellae of $\alpha_2$-$Ti_3Al$ and γ-TiAl, as well as silicide precipitates, and essentially no β phase.

11. A component made of the TiAl alloy of claim 10.

12. The component of claim 11, wherein the TiAl alloy comprises less than 5 vol. % of β phase at working temperatures of up to 900° C.

13. The component of claim 11, wherein the globular colonies of lamellae of $\alpha_2$-$Ti_3Al$ and γ-TiAl form at least 95 vol. % of the TiAl alloy.

14. A method for producing a component made of a TiAl alloy, wherein the method comprises melting a TiAl alloy which comprises titanium, from 42 to 48 at. % aluminum, from 3 to 5 at. % niobium, from 0.05 to 1 at. % molybdenum, from 0.2 to 2.2 at. % silicon, from 0.2 to 0.4 at. % carbon, from 0.05 to 0.2 at. % boron, 0 to 2.0 at. % tungsten, 0 to 3.5 at. % zirconium, 0 to 0.3 at. % hafnium, and unavoidable impurities, titanium being provided in a quantity such that the sum of proportions of chemical elements amounts to 100 at. %, with the proviso that the alloy comprises (i) at least 46 at. % aluminum; and/or (ii) not more than 0.5 at. % molybdenum; and/or (iii) at least one of tungsten, zirconium, and hafnium;

casting the melted TiAl alloy to form a semifinished product or atomizing the TiAl alloy to form a powder, precipitation-stabilizing the semifinished product, or a preliminary product produced from the semifinished product or the powder, by cooling the semifinished product or the preliminary product from a silicide starting temperature so that silicides are precipitated, heat-treating the precipitation-stabilized semifinished product or preliminary product in the α phase temperature range, in which silicide precipitates are present, for from 0.5 to 2 hours and cooling, so that globular colonies of lamellae of $\alpha_2$-$Ti_3Al$ and γ-TiAl are formed.

15. The method of claim 14, wherein precipitation stabilization is carried out directly during solidification from a melt or during cooling after compaction or shaping, and/or the silicide starting temperature lies above or below a silicide dissolution temperature.

16. The method of claim 14, wherein the α phase temperature range lies below a silicide dissolution temperature and above a gamma solvus temperature.

17. The method of claim 14, wherein the α phase temperature range, a silicide dissolution temperature and/or a gamma solvus temperature of the TiAl alloy is determined by simulation calculations and/or by test melts and metallographic examinations.

18. The method of claim 14, wherein the TiAl alloy comprises at least one of tungsten, zirconium, and hafnium.

19. The method of claim 14, wherein the TiAl alloy is selected in such a way that the TiAl alloy exhibits peritectic solidification with α-Ti phase formation or solidification with β phase formation.

20. The method of claim 14, wherein the heat-treated semifinished product or preliminary product is subjected to a second heat treatment at a temperature below a gamma solvus temperature for from 2 hours to 24 hours.

* * * * *